US006105410A

United States Patent [19]

Säuberlich et al.

[11] Patent Number: 6,105,410

[45] Date of Patent: Aug. 22, 2000

[54] METHOD FOR FORMING A HUB DISK AND METAL SPINNING ROLLER FOR USE IN THE FORMING OF A HUB DISK

[75] Inventors: Thomas Säuberlich, Gütersloh; Gerold Specht, Harsewinkel; Ralf Grünewald, Drensteinfurt; Matthias Schachtrup, Senden, all of Germany

[73] Assignee: Leico GmbH & Co. Werkzeugmaschinenbau, Ahlen, Germany

[21] Appl. No.: 09/268,726

[22] Filed: Mar. 17, 1999

[30] Foreign Application Priority Data

Oct. 29, 1998 [DE] Germany ..... 198 49 981

[51] Int. Cl.[7] ..... B21H 1/02

[52] U.S. Cl. ..... 72/71; 29/894.362

[58] Field of Search ..... 72/71, 82; 29/894.362

[56] References Cited

U.S. PATENT DOCUMENTS

| | | | |
|---|---|---|---|
| 2,379,584 | 7/1945 | Litton | 72/71 |
| 3,335,597 | 8/1967 | Gobien | 72/71 |
| 4,823,580 | 4/1989 | Kadotani | 72/105 |
| 5,823,904 | 10/1998 | Hodjat et al. | 29/894.362 |
| 5,829,291 | 11/1998 | Tanaka et al. | 72/71 |

*Primary Examiner*—Lowell A. Larson
*Attorney, Agent, or Firm*—Oblon, Spivak, McClelland, Maier, & Neustadt, P.C.

[57] ABSTRACT

The invention relates to a method for forming a hub disk, in which a circular blank-like workpiece is placed in a flow-forming machine and fixed with at least one overarm support, an area of the outer contour of the overarm support corresponding to an area of the inner contour of a hub to be formed, the circular blank-like workpiece is rotated, at least one roller is infed and substantially radially moved in, a material flow taking place on the workpiece, and the radial moving in of the roller is ended when the distance between an area of the outer profile of the roller and the overarm support corresponds to the desired thickness of the hub wall and during the infeeding of the roller the workpiece is initially contacted by a cutting or separating edge of the roller and the material flow along the roller and therefore the axial length of the hub is limited by the roller geometry. The invention also relates to a roller for use in forming a hub disk, the outer circumference of the roller having a cutting edge, with which it initially contacts a workpiece to be formed, and a circumferentially positioned projection spaced from the cutting edge is provided for limiting the axial material flow.

14 Claims, 8 Drawing Sheets

METHOD FOR FORMING A HUB DISK AND METAL SPINNING ROLLER FOR USE IN THE FORMING OF A HUB DISK

FIELD OF THE INVENTION

The invention relates to a method for forming a hub disk, in which a circular blank-like workpiece is placed in a flow-forming machine and fixed with at least one overarm support, in which an area of the outer contour of the overarm support corresponds to an area of the inner contour of a hub to be formed, the circular blank-like workpiece is rotated, at least one roller is infed and substantially radially moved in, a material flow taking place on the workpiece and the radial moving in of the roller is ended, when the distance between the roller and the overarm support corresponds to the desired thickness of the hub wall. The invention also relates to a metal spinning roller for use in forming a hub disk.

BACKGROUND OF THE INVENTION

DE 197 06 466 A1 discloses a method according to the preamble. A flow-forming roller compresses the circumferential area of a circular metal blank in such a way that in a central area of the blank material flows axially on a centrally positioned overarm support and consequently a hub is formed. The axial material flow is limited by the contour of the overarm support. The state of compressive stress, in which an axial material flow is brought about by radial pressure, is difficult to achieve. Fundamentally high forces are required. This can lead to an undesirably high material outflow and to a disadvantageously pronounced reduction in the workpiece thickness. As a result of the high forces, particularly with a high degree of forming, the risk exists of the hub being torn from the circular blank during forming.

A comparable method is disclosed by DE 44 44 526 C1. In this case a hub is formed on the tool pin of the main spindle of a flow-forming machine, the axial material flow being limited by a tail stock. The latter has a diameter larger than the tool pin diameter. As a result of the stop obtained material can only flow to the correspondingly predetermined position. The problems caused by the high compressive stresses are comparable with those of DE 197 06 466 A1.

A further hub forming possibility is disclosed by DE 196 43 820 C1. In the described method the hub is formed in such a way that an externally engaging roller initially leads to the formation of a fold, which is then compressed to the hub. This method suffers from the disadvantage that during fold formation cracking can occur if the deformability of the material is exceeded and this ultimately leads to an instability of the workpiece. A hub formed in this way has a lower strength than a solid hub with respect to subsequent stresses. When high forces are applied the fold can encourage crack propagation.

Another method for producing a hub is disclosed by DE 195 13 634 C2, where a flange-like projection of a workpiece is radially split into two "wings" and subsequently one of these wings is pressed against a chuck and the wing is quasi "turned round", so that the desired hub is obtained.

Another example for forming a hub is known from EP 824 049 A1. In this case a metal spinning roller moves the workpiece material in "wavy" manner towards the center of a workpiece, so that ultimately a hub is formed. It is disadvantageous in this method in that it only permits the production of short, thin-walled hubs. The production process is also difficult, because it is necessary to set a complex, three-dimensional state of stress.

DE 196 20 812 A1 provides a possibility of forming a hub in simple manner from a tubular workpiece. This per se adequately functioning method is consequently based o n a different starting workpiece a nd is therefore unsuitable for eliminating the aforementioned prior art disadvantages in the case of fabrication from a circular blank.

Other conventional methods for the production of hubs make use of the joining together of two or more semifinished parts. As a result of this joining together there are always manufacturing tolerances, which impair the quality of the end product. As the joining together usually takes place by welding, there is a further undesired consequence in that the workpieces are distorted as a result of th e heat influence. There is also a risk of modifications to the workpiece structure.

It is also known to produce a hub by pressing a cylindrical mandrel through a perforated preform. As a result material volume is ironed out from the inner area of the perforated preform to provide a hub. There are also restrictions to this method in connection with the hub thickness and length which can be produced.

SUMMARY OF THE INVENTION

Thus, the object of the invention is to eliminate the aforementioned disadvantages of the prior art and in particular to provide a simple and efficient method and a metal spinning roller usable for the same, with which a plurality of hub shapes can be accurately fabricated.

The invention is based on a method according to the preamble in that to the workpiece is fed a roller with a separating or cutting edge and a compression area adjacent thereto, whose outer profile corresponds to an external circumferential contour of the hub to be formed, that during the infeeding of the roller the workpiece is contacted by a roller cutting edge and workpiece material is partly separated or cut and that the separated material flows axially along the compression area of the roller and is radially compressed, the hub being formed in accordance with the outer profile of the compression area. Starting from a geometrically simple preform, namely a circular blank-like workpiece, this method makes it possible in an effective manner to produce complex workpieces. In particular, there is no longer a need to join together several semifinished parts. As a result of the fact that during the infeeding of the roller the workpiece is initially contacted by a separating or cutting edge of the roller, it is possible to work with reduced compressive forces, so that the disadvantages of the prior art associated with the high forces necessary are eliminated. Compared with a blunt roller, the roller provided with a cutting edge penetrates the workpiece relatively easily. Subsequently, as a result of the radial moving in of the roller, there is a material flow in a substantially axial direction, accompanied by a radial compression.

Unlike in the prior art, the axial material flow is not spaced from the roller on a central, forming or shaping device, such as e.g. a tool pin, but is instead directly located on the metal spinning roller throughout the infeeding process. As a result the instantaneously acting forces are reduced, which has a positive effect for a rapid, geometrically accurate production process. The method according to the invention is particularly advantageous as a result of the fact that the axial length and the contour of the hub is defined by the roller geometry, i.e. the outer profile of the compression area with a compression shoulder or step. This e.g. ensures that any initial material flow in the axial direction is limited by the roller and an overhang is formed, which is compressed and thickened by the further radial infeeding. Another advantage linked with the shaping through the roller geometry is that by simply changing the roller the hub geometry can be changed. The compression area can have an essentially straight, convex or concave outer profile, so that it is also possible to form hubs which are not cylindrical.

It is advantageous, after the end of the radial introduction and prior to the ending of the forming process, to allow a holding time for calibration purposes. In conjunction with the preceding method steps, this additionally improves the hub shape and the material structure. A workhardening takes place, which leads to a greater resistance to cracking and to a higher wear resistance and fatigue strength of the hub.

It can be advantageous if the hub and/or the overarm support and/or an extension of the overarm support are supported by at least one supporting roller. Thus, on forming a high strength material, an excessive bulging or bending out of the workpiece with the tool during forming is prevented and consequently a greater dimensional precision is achieved.

It can also be useful to infeed at least one axial supporting roller for supporting the workpiece. This is in particular advantageous if a particularly thin circular blank wall thickness is chosen. The choice of this wall thickness can, in conjunction with the determination of the size of the hub to be fabricated, mainly be approximately theoretically calculated. It is also possible to establish whether it is advantageous to use an axial supporting roller. The use of a supporting roller in the case of small wall thicknesses can prevent bulging during workpiece forming and can lead to a further workhardening and smoothing of the circular blank edge or rim.

According to a preferred embodiment the cutting edge of the roller is applied to the outer edge of the workpiece. As a result material from the entire circumference of the circular blank can be used for the formation of the hub. A uniform disk thickness, which is desired in certain circumstances, is also obtained.

According to another development of the method, the cutting edge of the roller is applied within the outer edge to the workpiece. This variant can also be advantageous if the outer edge is to have an increased thickness. This can be useful with regards to the formation of a tooth system or any other shaping of the outer edge.

The method is also advantageously further developed in such a way that the edge of the formed workpiece is thickened and/or bent round by flow-forming, curling or fold compression and with a further roller a profile or tooth system is formed . This makes it possible to fabricate different types of parts, in accordance with the given requirements.

The overarm support is preferably cylindrical, so that conventional hubs with a cylindrical inner contour can be formed between the overarm support and the roller. Fundamentally other shapes are conceivable, such as a conical construction of the overarm support.

In another advantageous method variant, the circular blank-like workpiece is chucked with two overarm supports acting against one another and in this setting the workpiece is worked on both sides and on said both sides a hub area is formed. By performing the method in this way it is possible, without rechucking, to form hubs on both sides of the workpiece, the internal diameter thereof in each case corresponding to the external diameters of the counterparts. In a single operation and in one setting, it is consequently possible to produce two hubs.

Working advantageously takes place simultaneously through at least two rollers. Modern flow-forming machines permit the simultaneous infeeding of ten or more spinning rollers. The latter are advantageously distributed over the workpiece circumference in such a way that the radial transverse or bending forces are compensated. The rollers can be arranged and infed in pairwise, axially facing manner. In the latter case it is also advantageous to support the outer edge of the workpiece with a supporting roller having a groove all along its circumference. This is particularly useful if as a result of the forming of the two hubs, all that is left is a thin central web, so that as a result of the stabilization a bulging of said central web can be prevented.

The invention also relates to a metal spinning roller for use in forming a hub disk, which is provided on its circumference with a separating or cutting edge, with which it is possible to separate a material area of a circular blank-like workpiece, as well as an adjacent compression area with an outer profile and a circumferentially arranged projection, the outer profile of the compression area corresponding to an external circumferential contour of the hub to be formed. Said roller makes available the aforementioned advantages of the method according to the invention. In particular, the roller simultaneously fulfils several functions. Firstly it is used for a comparatively easy penetration of the roller into the workpiece. It also leads to the material flow necessary during infeeding for the formation of the hub. It also forms the boundary for the axial material flow and leads to the radial compression and thickening to the desired final shape.

The circumferential surfaces of the roller adjacent to the cutting edge form an obtuse or advantageously an acute angle, so that a wedge-shaped cutting edge is formed. This provides an adequate free space for the case of a right-angled application of the hub, which permits an unhindered infeeding of the roller.

BRIEF DESCRIPTION OF THE DRAWINGS

The invention is described in greater detail hereinafter relative to embodiments and the attached drawings, wherein are shown.

DESCRIPTION OF THE PREFERRED EMBODIMENTS

Figure 1:
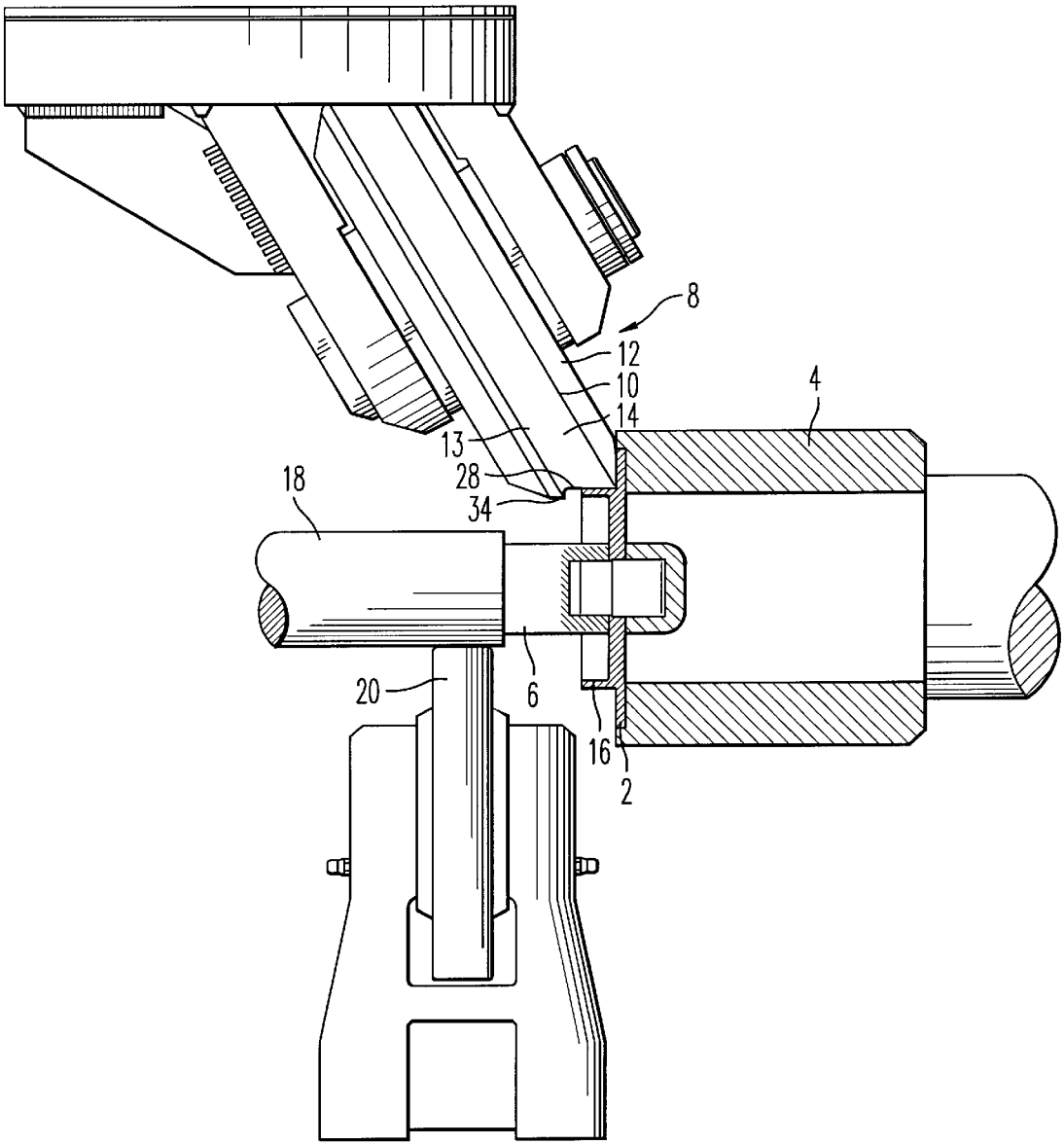
FIG. 1 A partially sectional plan view of a flow-forming machine in a first method stage.

FIG. 1 shows an intermediate stage in the production of a hub disk from a circular blank-like workpiece 2. The workpiece 2 is inserted in a mounting support 4 of a flow-forming machine and is fixed in said support 4 by means of a cylindrical overarm support 6. The external diameter of the overarm support 6 corresponds to the internal diameter of the hub to be produced. The main spindle of the flow-forming machine is rotated together with the overarm support 6 and a rotationally symmetrical roller 8 with a special outer profile 14 is infed radially to the centre of the workpiece 2. The roller 8 has a cutting edge 10 and the circumferential surfaces 12, 13 of the roller 8 adjacent to the edge form an acute angle. By infeeding the roller 8 material is partly separated and passed along a compression area 28 of the roller 8, so that, starting from the circular blank-like workpiece 2, a circumferential collar 16 is formed, which constantly changes during the infeeding process. The axial material flow is limited by a circumferential edge or a projection 34 of the roller 8. In the present embodiment an extension 18 of the overarm support 6 is supported by a supporting roller 20. This makes it possible to work strong steels and consequently the action of higher, necessary forces.

Figure 2:
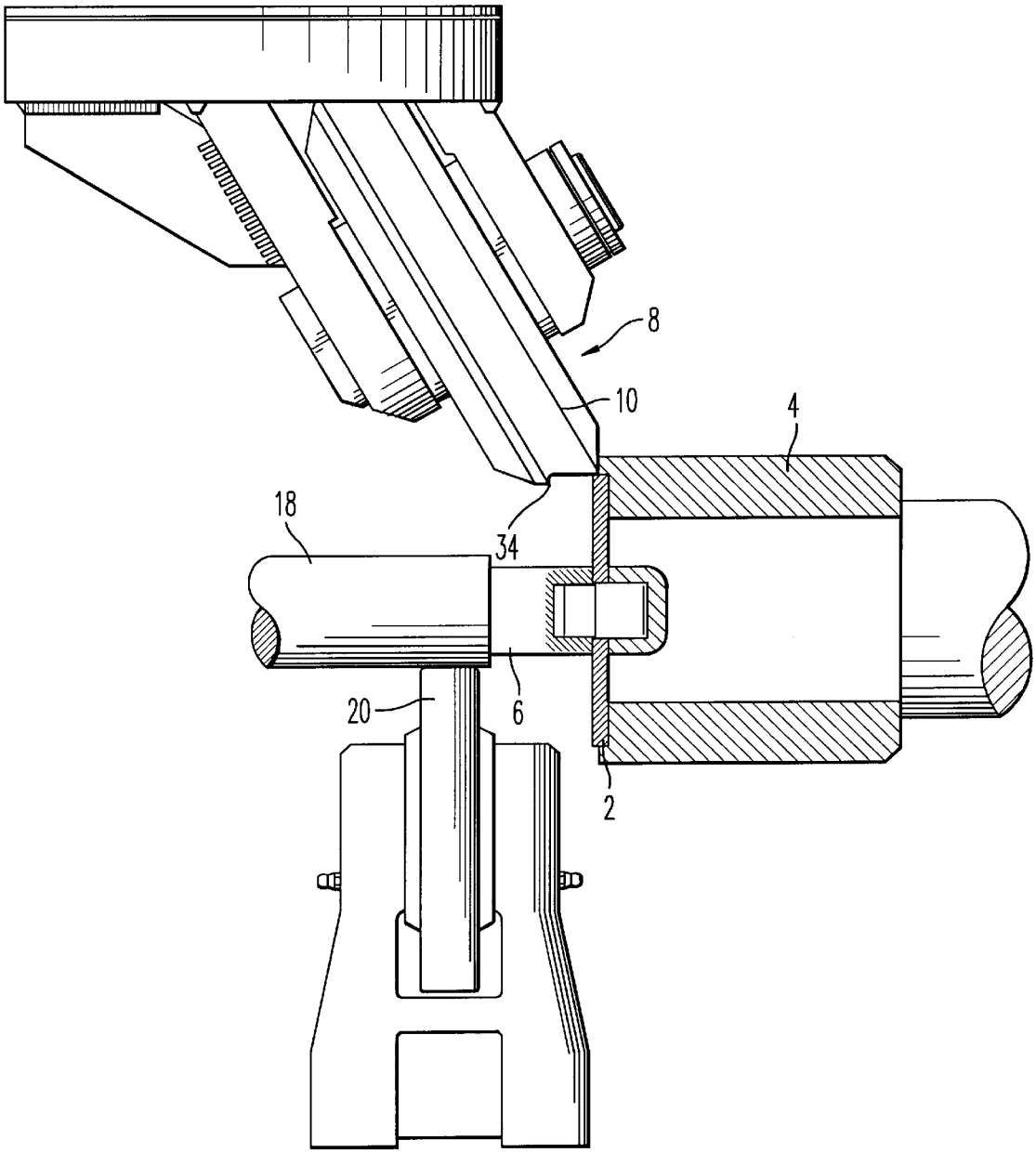
FIG. 2 A partially sectional plan view of a flow-forming machine in a second method stage.

FIG. 2 shows an arrangement comparable to FIG. 1. Unlike in FIG. 1 an instantaneous photograph is shown, in which the roller 8 is located on the edge or rim of the circular blank-like workpiece 2. At this time the workpiece 2 has not yet undergone any material displacement. Through the contact of the cutting edge 10 of the roller 8 with the rim of the workpiece 2, starting from the outer rim, in uniform manner material is branched off from the workpiece 2 and used for forming the hub. In the construction shown in FIG. 2, the separating or cutting edge 10 of the roller 8 is applied to the edge or rim of the workpiece 2. However, it is also conceivable for application to only take place within the rim of the workpiece 2, so that the marginal area of the workpiece 2 is thicker than a central area, which can be useful during certain, following processing steps.

Figure 3:
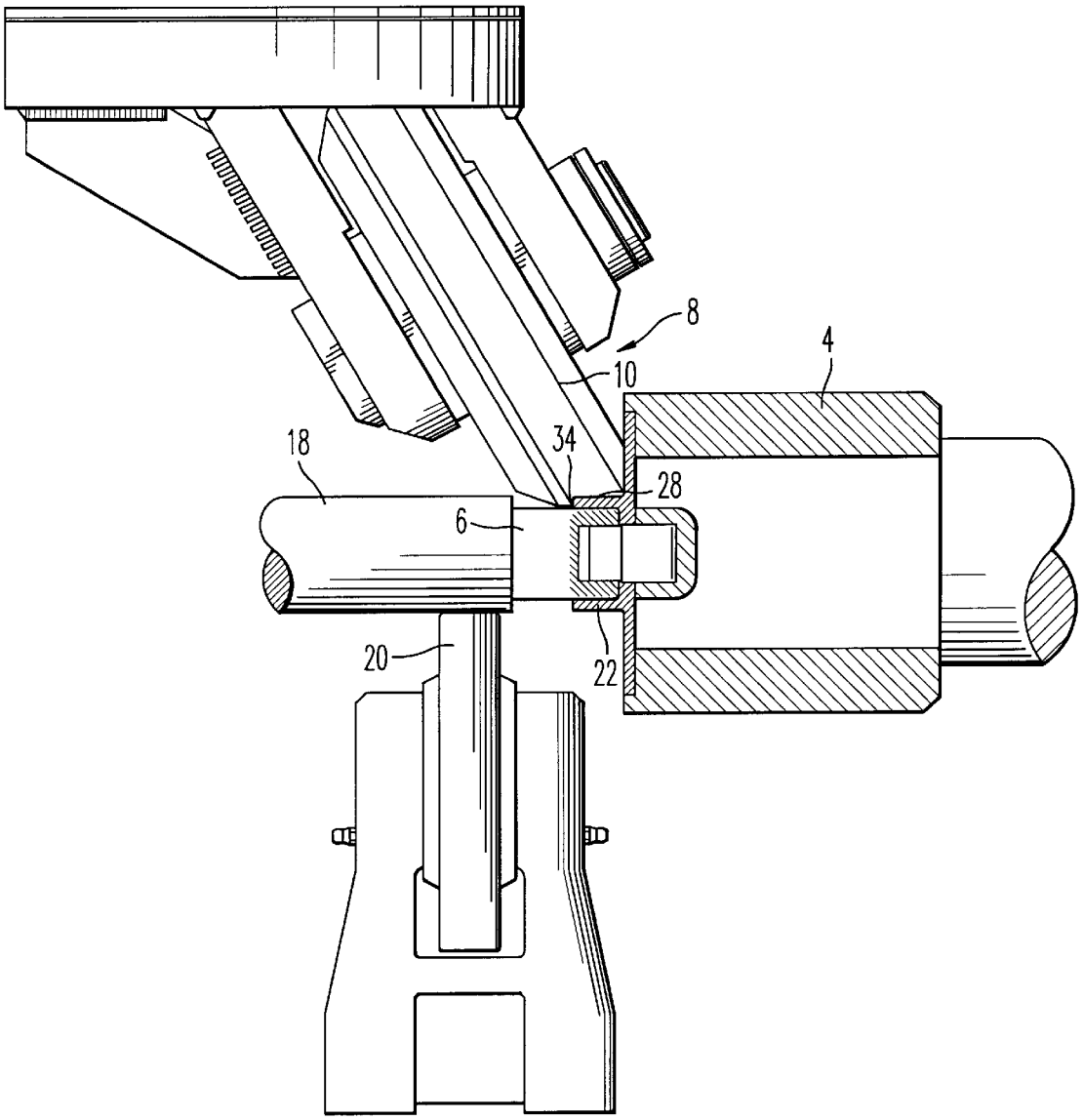
FIG. 3 A partially sectional plan view of a flow-forming machine in a third method stage.

FIG. 3 shows a method stage, in which the hub 22 is formed on the overarm support 6. The axial expansion of the hub 22 is limited by the circumferential projection 34 of the roller 8. Infeeding of the roller 8 is ended at the time wnen the spacing of the compression area 28 corresponds to the desired thickness of the hub 22. A holding time can be planned within said state for calibrating and workhardening the hub 22.

Figure 4:
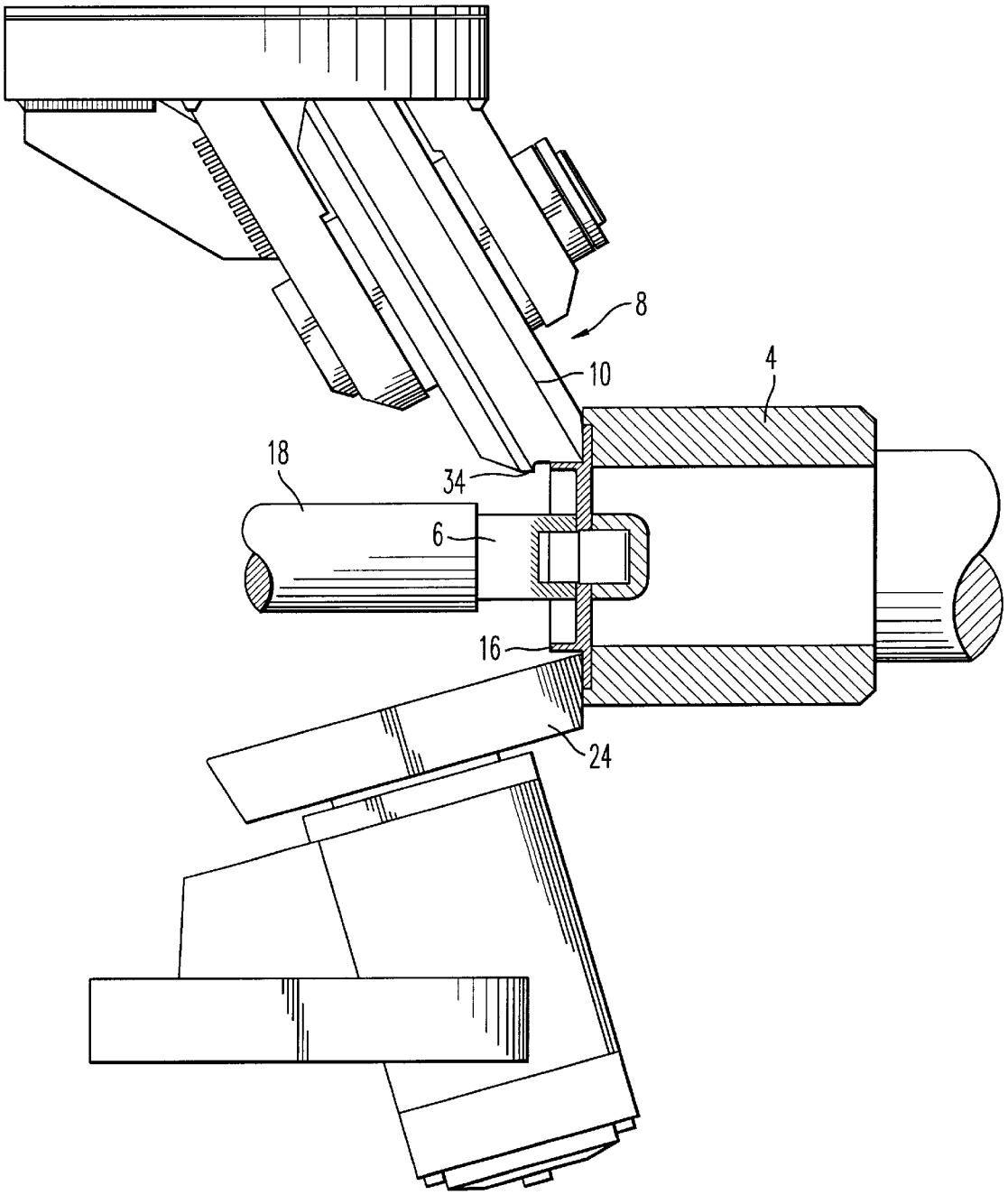
FIG. 4 A partially sectional plan view of a flow-forming machine in a fourth method stage.

FIG. 4 once again shows an intermediate state of the method according to the invention. In this case there is at least one axial supporting roller 24, which can be used alone or together with the radial supporting roller or rollers 20 according to FIGS. 1 to 3. The supporting roller 24 prevents a bulging of the workpiece 2 during forming and can lead to a further workhardening and smoothing of the circular blank rim. This is particularly useful with small wall thicknesses.

Figure 5:
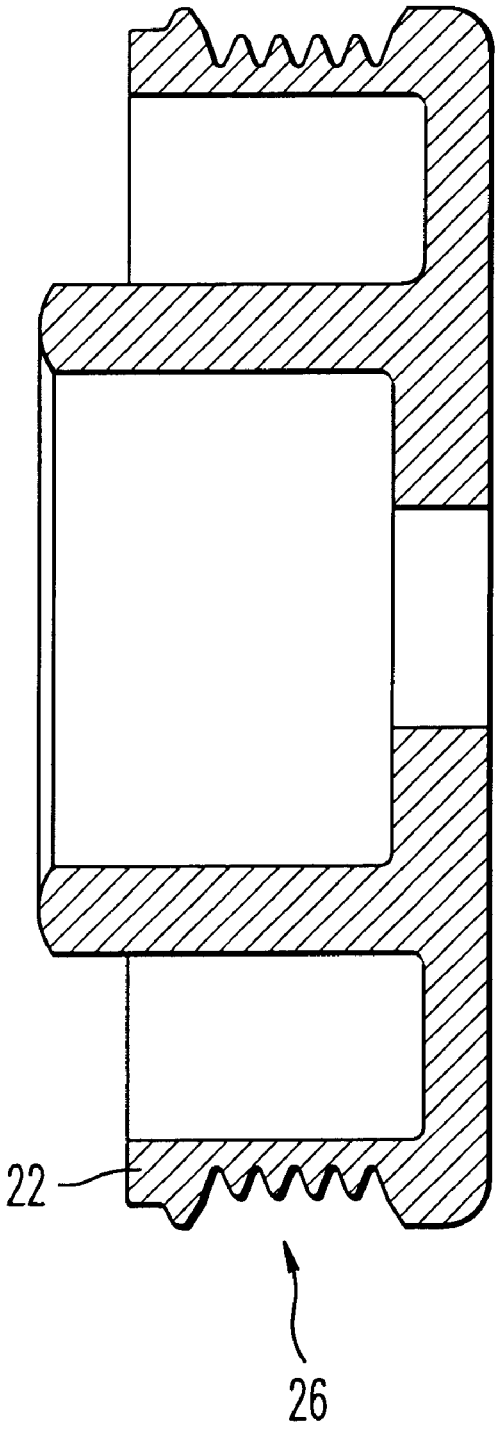
FIG. 5 A section through a workpiece produced by the method according to the invention.

FIG. 5 shows an example of a workpiece produced according to the invention in which, following the forming of the hub 22, the radial circular blank area is reversed. A poly-V-profile 26 is formed in the outer area of reversed circular blank area.

Figure 6:
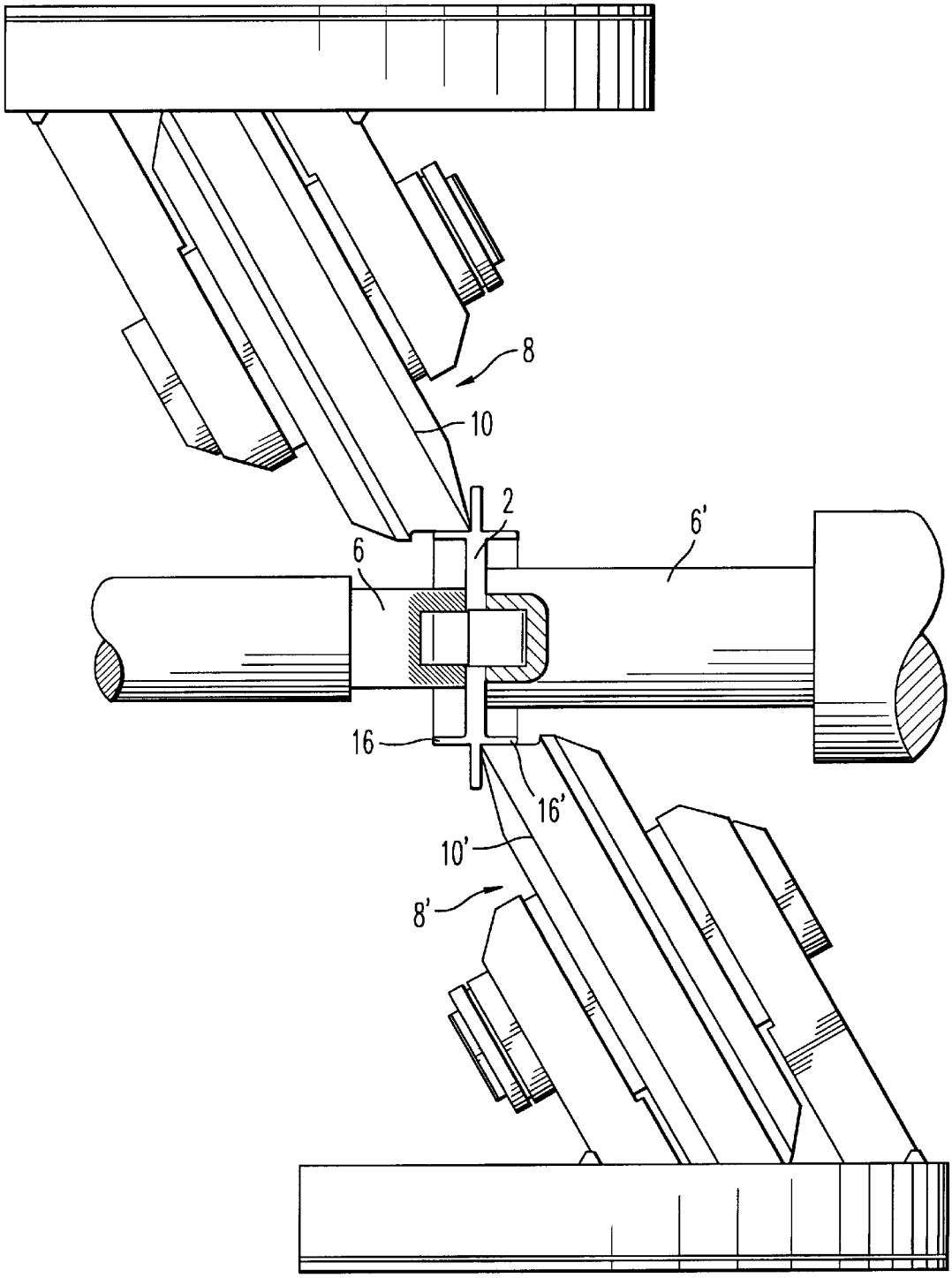
FIG. 6 A partially sectional plan view of a flow-forming machine in a fifth method stage.

Another embodiment of the invention is shown in FIG. 6. The essential point is that the workpiece is held by two overarm supports 6, 6'. Two rollers 8, 8' are simultaneously infed and act on different sides of the workpiece 2. Thus, on each side of the workpiece 2 is obtained a collar 16, 16' and ultimately hubs, which are in accordance with the external diameters of the overarm supports 6, 6'. Thus, in a single operation, a hub can be formed on both sides of the workpiece 2.

Figure 7:
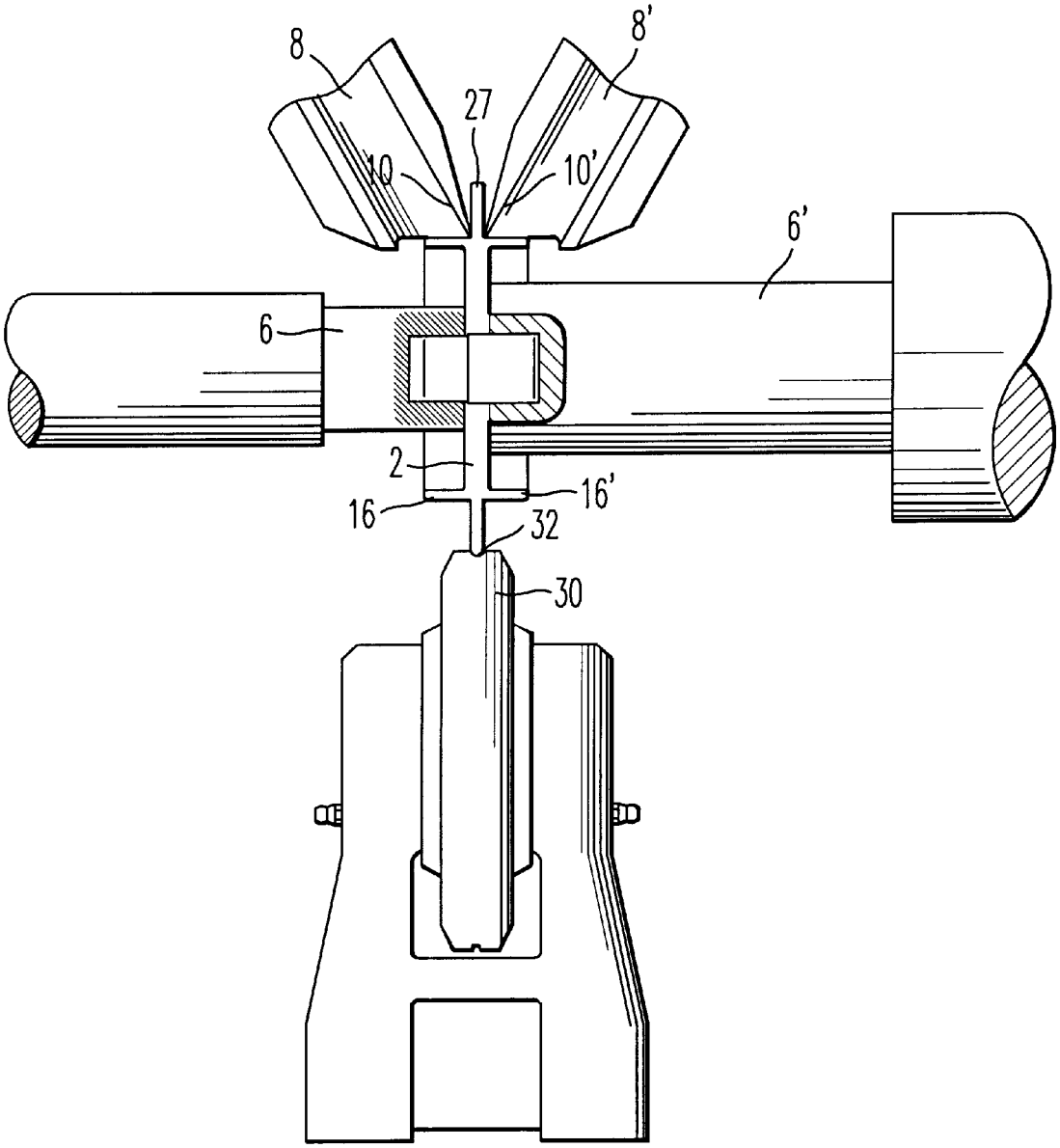
FIG. 7 A partially sectional plan view of a flow-forming machine in a sixth method stage.

FIG. 7 shows the situation where, during forming, only a thin central web 27 is left or the central web 28 is geometrically unstable. It is then particularly useful, if in the manner shown in FIG. 7, use is made of a further supporting roller 30, which stabilizes the central web 28 with a circumferential groove 32. This prevents a bulging of the central web 27. Simultaneously the roller 30 can be used for preventing a radial thinning out of the workpiece, which would lead to an increase in the diameter. Following onto the formation of the hubs, the central web 27, like the circular blank rim in the other embodiments of the invention, can be modified in numerous different ways.

Figure 8:
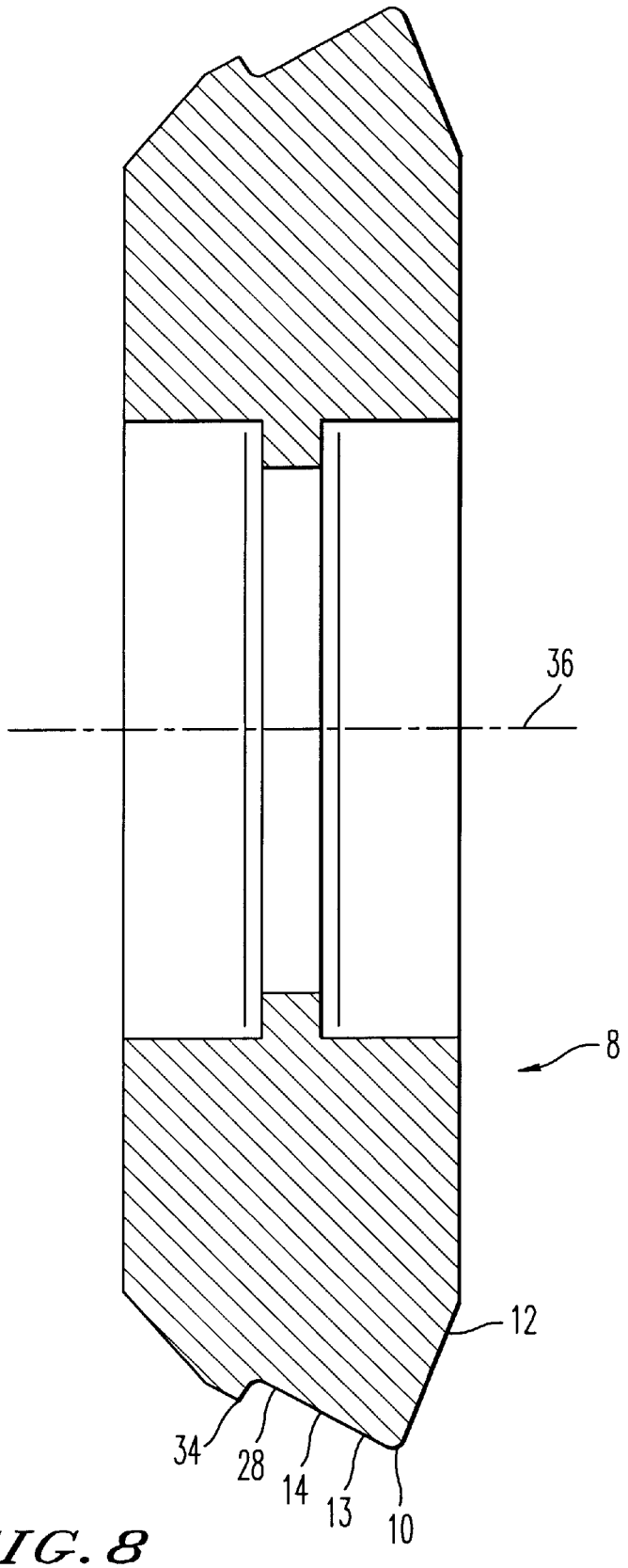
FIG. 8 A cross-section through a roller according to the invention.

FIG. 8 finally shows an example of a roller according to the invention. The essential points are the cutting edge 10, the adjacent compression area 28 and the following radial projection 34. The circumferential surfaces 12, 13 form an acute, almost right angle of the cutting edge 10, so that the roller 8 can be used in the inventive method. In operation, the roller 8 with its rotation axis 36 sloping towards the compression area 28 is so positioned that material flows roughly parallel to the workpiece axis along the compression area 28 with the outer profile 14 up to the circumferential projection 34 of the roller 8. The axial length and shape of the hub can be fixed by the roller geometry.

The features of the invention disclosed in the above description, drawings and claims can be essential to the implementation of the invention, both individually and in random combination.

What is claimed is:

1. Method for forming a hub disk by using a roller, which comprises:

placing a circular blank-line workpiece in a flow-forming machine and engaging said workpiece with at least one overarm support to secure the workpiece in place such that an area of the outer contour of the support is formed corresponding to an area of the inner contour of a hub to be formed, said flow-forming machine including a roller with a cutting edge moveable in a substantially radial direction so as to engage the workpiece and partly separate material of the workpiece, rotating the circular blank-line workpiece on said support, engaging said workpiece with said cutting edge so as to partly separate material of said workpiece, pressing with said roller the partly separated material against the overarm support so as to shape the hub, guiding the partly separated material from the cutting edge, during moving of the roller, to an adjacent compression area of the roller, an outer profile of the compression area being shaped in accordance with the outer contour of the hub to be formed, causing the partly separated material to flow axially along the compression area of the roller and be radially compressed, said roller having a projection positioned thereon, stopping the flow of the material which flows axially along the compression area of said projection of the roller, and forming a hub between the compression area, the projection and the overarm support.

2. Method according to claim 1, wherein following completion of radial movement in and prior to the completion of the forming process, the material is held in place for calibration purposes.

3. Method according to claim 1, which comprises supporting at least one of said hub, said overarm support and an extension of the overarm support by said roller.

4. Method according to claim 1, wherein said roller comprises at least one axial support roller and wherein the support step comprises supporting the workpiece by said axial supporting roller.

5. Method according to claim 1, which comprises engaging the cutting edge of the roller with an outer rim of the workpiece.

6. Method according to claim 1, which comprises engaging the cutting edge of the roller with the workpiece within the outer rim to the workpiece.

7. Method according to claim 1, which comprises fixing the rim of the formed workpiece by one of a flow-forming step, a curling step and a fold compression step and forming one of a profile and tooth system by engaging the rim with an additional roller.

8. Method according to claim 1, which comprises fixing a central area of the circular blank-like workpiece with first and second overarm supports acting against one another and working the workpiece on both sides so as to form a hub area on each of said sides.

9. Method according to claim 1, which comprises working said workpiece simultaneously with at least two rollers.

10. Method according to claim 9, which comprises positioning a plurality of rollers over the circumference of the workpiece and radially infeeding said rollers so that radially directed transverse forces are compensated for during forming of the workpieces.

11. Method according to claim 9, which comprises partially infeeding the rollers in a pairwise axially facing manner.

12. Method according to claim 11, which comprises, providing, with respect to said pair of rollers, a radially facing supporting roller having along a circumference thereof with a groove and engaging the outer rim of the workpiece with said groove.

13. Metal spinning roller for forming a hub disk from a workpiece, which comprises a roller having a cutting edge located on a circumference portion thereof a roller;

an adjacent compression area of the roller having an outer profile, wherein the cutting edge is positionable in a lateral area of the workpiece for partly separating material from the workpiece, said compression area including a projection on a side portion thereof which is spaced from the cutting edge thereof, the projection stopping the flow of material along the compression area.

14. Roller according to claim 13, wherein circumferential surfaces of the roller adjacent to the cutting edge forming an acute angle and a wedge-shaped cutting edge.

* * * * *